US005744435A

United States Patent [19]

Hartman et al.

[11] Patent Number: 5,744,435

[45] Date of Patent: Apr. 28, 1998

[54] PERFUMES FOR LAUNDRY AND CLEANING COMPOSITIONS

[75] Inventors: Frederick Anthony Hartman, Cincinnati; Mark Robert Sivik, Fairfield; John Cort Severns, West Chester; Scott William Waite, Cincinnati, all of Ohio; Cynthia Lee Eddy, West Harrison, Ind.

[73] Assignee: The Procter & Gamble Company, Cincinnati, Ohio

[21] Appl. No.: 846,162

[22] Filed: Apr. 25, 1997

Related U.S. Application Data

[62] Division of Ser. No. 517,941, Aug. 22, 1995, Pat. No. 5,652,205, which is a division of Ser. No. 277,558, Jul. 19, 1994, abandoned.

[51] Int. Cl.[6] ..... C11D 3/50

[52] U.S. Cl. ..... 510/101; 510/102; 510/107; 510/276; 510/353; 510/361; 510/367; 510/392; 510/394

[58] Field of Search ..... 510/101, 102, 510/107, 276, 353, 361, 367, 392, 394

[56] References Cited

U.S. PATENT DOCUMENTS

| | | | |
|---|---|---|---|
| 2,220,854 | 11/1940 | Slagh | 260/485 |
| 3,077,457 | 2/1963 | Kulka | 252/305 |
| 4,151,357 | 4/1979 | Mishima et al. | 544/386 |
| 4,199,519 | 4/1980 | Mishima et al. | 260/413 |
| 4,440,663 | 4/1984 | Boyer et al. | 252/174.11 |
| 5,298,569 | 3/1994 | Yamamori et al. | 525/329.5 |
| 5,312,950 | 5/1994 | Boaz | 558/51 |
| 5,531,910 | 7/1996 | Severns et al. | 510/107 |
| 5,559,088 | 9/1996 | Severns et al. | 510/102 |
| 5,562,897 | 10/1996 | Mitchnick et al. | 424/59 |
| 5,648,328 | 7/1997 | Angell et al. | 510/101 |
| 5,652,205 | 7/1997 | Hartman | 510/101 |
| 5,656,584 | 8/1997 | Angell et al. | 510/101 |

FOREIGN PATENT DOCUMENTS

| | | | |
|---|---|---|---|
| 118611 | 9/1984 | European Pat. Off. . | |
| 397245 | 11/1990 | European Pat. Off. | C11D 3/50 |
| 404470 | 12/1990 | European Pat. Off. | A61K 7/46 |
| 430315 | 6/1991 | European Pat. Off. | C11D 3/386 |
| 1286692 | 1/1969 | Germany . | |
| 50-029877 | 3/1975 | Japan . | |
| 53-018510 | 2/1978 | Japan . | |
| 53-053614 | 5/1978 | Japan . | |
| 64-001799 | 1/1989 | Japan | C11D 3/50 |
| 3-17025 | 1/1991 | Japan | A61K 47/48 |
| 2087885 | 6/1982 | United Kingdom | C07C 69/743 |
| WO 94/13766 | 6/1994 | WIPO | C11B 9/00 |
| WO 95/04809 | 2/1995 | WIPO | C11D 3/50 |

OTHER PUBLICATIONS

Cori, Osvaldo, "Rearrangement of Linalool, Geraniol, and Nerol and Their Derivatives", J. Org. Chem. (1986) vol. 51, pp. 1310–1316 Month Unavaliable.

Schmid, *Tetrahedron Letters*, 33, p. 757(1992) Month Unavailable.

Carey et al., Advanced Organic Chemistry, Part A, 2nd Ed., pp. 421–426 (Penum, NY; 1984) Month Unavailable.

Chemical Abstracts Service, Abstract #66(7): 28371h (1967) Month Unavailable.

Chemical Abstracts Service, Abstract #117(26): 253848k (1992) Month Unavailable.

Chemical Abstracts Service, Abstract #115(14): 141973Z (1991) Month Unavailable.

Chemical Abstracts Service, Abstract #71:24728, Weitzel (1969) Month Unavailable.

Mukaiyama et al., *Chem. Letters*, pp. 563–566 (1980) Month Unavailable.

"Geranyl crotonate", *Food Cosmet. Toxicol.*, 1974, 12, p. 891 Month Unavailable.

"Geranyl phenylacetate", *Food Cosmet. Toxicol.*, 1974, 12, p. 895 Month Unavailable.

Patent Abstracts of Japan, JP 59001446, Jan. 6, 1984 (Toray).

Derwent Abstract, JP 48043329 (Toray Ind.) date unavailable.

Derwent Abstract, JP 3181599, Aug. 7, 1991 (Lion Corporation).

Derwent Abstract, JP 2034696, Feb. 5, 1990 (Kao Corporation).

Derwent Abstract, JP 59001410, Jan. 6, 1984 (Toray Ind.).

Derwent Abstract, JP 2166195, Jun. 26, 1990 (Lion Corporation).

Derwent Abstract, JP 60023498, Feb. 6, 1985 (Lion Corporation).

Derwent Abstract, JP 63035696, Feb. 16, 1988 (Lion Corporation).

Mohacsi, Erno, "Regioselective Epoxidation of Geranyl Palmitate with Metachloroperbenzoic Acid", *Synthetic Communications*, 21(21), (1991), pp. 2257–2261 Month Unavailable.

Erdmann, Ernst, "Ueber einige Ester und einen krystallisirten Pseudoester des Rhodinols", *Chem. Ber.*, 31, (1898), pp. 356–360 Month Unavailable.

U.S. application No. 08/761585, Hartman et al., filed Dec. 06, 1996.

U.S. application No. 08/482,668, Sivik, filed Jul. 7, 1995

*Primary Examiner*—Jacqueline V. Howard

*Attorney, Agent, or Firm*—R. S. Echler, Sr.; B. M. Bolam; K. W. Zerby

[57] ABSTRACT

Laundry and cleaning compositions comprising a nonionic or anionic ester of an allylic alcohol perfume having the formula:

$$R-[\overset{O}{\overset{\|}{C}}-O-CR_2'-CR''=CR_2''']_n,$$

especially geranyl and neryl esters.

16 Claims, No Drawings

PERFUMES FOR LAUNDRY AND CLEANING COMPOSITIONS

This is a divisiion of application Ser. No. 08/517,941, filed on Aug. 22, 1995, now U.S. Pat. No. 5,652,305 which is a division of application Ser. No. 08/277,558, filed Jul. 19, 1994 (now abandoned).

FIELD OF THE INVENTION

The present invention relates to laundry and cleaning products comprising nonionic or anionic esters of allylic alcohol perfumes.

BACKGROUND OF THE INVENTION

Consumer acceptance of cleaning and laundry products is determined not only by the performance achieved with these products but the aesthetics associated therewith. The perfume systems are therefore an important aspect of the successful formulation of such commercial products.

What perfume system to use for a given product is a matter of careful consideration by skilled perfumers. While a wide array of chemicals and ingredients are available to perfumers, considerations such as availability, cost, and compatibility with other components in the compositions limit the practical options. Thus, there continues to be a need for low-cost, compatible perfume materials useful for cleaning and laundry compositions.

It has been discovered that esters of certain nonionic and anionic allylic perfume alcohols are particularly well suited for laundry and cleaning compositions. In particular, it has been discovered that depending on the acid group utilized and/or the laundry/cleaning compositions into which these are incorporated, esters of allylic perfume alcohols will hydrolyze to give one or more of the possible allylic alcohol perfumes. In addition, slowly hydrolyzable esters of allylic perfume alcohols provide release of the perfume over a longer period of time than by the use of the perfume itself in the laundry/cleaning compositions. Such materials therefore provide perfumers with more options for perfume ingredients and more flexibility in formulation considerations. These and other advantages of the present invention will be seen from the disclosures hereinafter.

BACKGROUND ART

Mechanistic studies are discribed in Schmid, *Tetrahedron Letters* 33, p. 757 (1992); and Cori et al., *J. Org. Chem.*, 51, p. 1310 (1986). Carey et al., *Advanced Organic Chemistry. Part A*, 2nd Ed., pp. 421–426 (Plenum, N.Y.; 1984) describes ester chemistry more generally.

Compositions of fragrance materials (having certain values for Odour Intensity Index, Malodour Reduction Value and Odour Reduction Value) said to be used as fragrance compositions in detergent compositions and fabric conditioning compositions are described in European Patent Application Publication No. 404,470, published Dec. 27, 1990 by Unilever PLC. Example 1 describes a fabric-washing composition containing 0.2% by weight of a fragrance composition which itself contains 4.0% geranyl phenylacetate.

SUMMARY OF THE INVENTION

The present invention relates to laundry and cleaning compositions comprising:

(a) from about 0.01% to about 10%, by weight of the composition, of a nonionic or anionic ester of an allylic alcohol perfume having the formula:

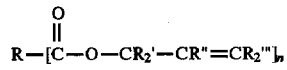

wherein R, R', R", and R'" are as described hereinafter, and n is an integer of 1 or greater; and (b) from about 90% to about 99.99%, by weight of the composition, of ingredients useful for formulating laundry and cleaning compositions.

R is selected from the group consisting of $C_1$ –$C_{30}$, preferably $C_1$–$C_{20}$, straight, branched or cyclic alkyl, alkenyl, alkynyl, alkylaryl, or aryl group, and represents the group attached to the carboxylate function of the carboxylic acid used to make the perfume ester. R is selected to give the perfume ester its desired chemical and physical properties such as: 1) chemical stability in the product matrix, 2) formulatability into the product matrix, 3) desirable rate of perfume release, etc. The product(s) and rate of hydrolysis of the allylic alcohol ester can be controlled by the selection of R. More specifically, while not to be limited by theory, it is believed that when R is an electron donating group (such as alkyl) the hydrolysis product will tend to be the rearranged allylic alcohol, whereas electron withdrawing groups (such as phenyl) will tend to release the non-rearranged perfume alcohol upon hydrolysis. Esters of acids having more than one acid moiety per molecule (e.g., diesters; triesters) are also included within the useful esters of allylic perfume alcohols.

Each R' is independently selected from the group consisting of hydrogen, or a $C_1$–$C_{25}$ straight, branched or cyclic alkyl, alkenyl, alkynyl, alkylaryl, or aryl group. The two R' moieties may be the same or different. Preferably one R' is hydrogen. More preferably, both R' moieties are hydrogen.

R" is selected from the group consisting of hydrogen, or a $C_1$–$C_{25}$ straight, branched or cyclic alkyl, alkenyl, alkynyl, alkylaryl, or aryl group. Preferably, R" is hydrogen.

Each R'" is independently selected from the group consisting of hydrogen, or a $C_1$–$C_{25}$ straight, branched or cyclic alkyl, alkenyl, alkynyl, alkylaryl, or aryl group. The R'" may be the same or different. Preferably, one R'" is hydrogen or a straight, branched or cyclic $C_1$–$C_{20}$ alkyl or alkenyl groups. More preferably, one R'" is hydrogen, methyl, or ethyl, and the other R'" is a straight, branched or cyclic $C_1$–$C_{20}$ alkyl, alkenyl or alkylaryl group. More preferably, one R'" is a straight, branched or cyclic $C_1$–$C_{20}$ alkyl or alkenyl group.

In the most preferred embodiment, R' and R" are hydrogen, one R'" is hydrogen, methyl, or ethyl, and the other R'" is a straight, branched or cyclic $C_1$–$C_{10}$ alkyl or alkenyl group.

Those skilled in the art will recognize that structural isomers of the above structure are possible. Specifically, cis/trans (also referred to as Z/E) isomers at the double bond in the structure shown above are possible.

Those skilled in the art will also recognize that stereoisomers of the above structure are possible. Specifically, when the two R' groups are different from one another stereoisomers referred to as "R/S" are possible. Again, all possible steroisomers are included within the above present invention structure.

In addition, each of the above R, R', R", and R'" moeities may be unsubstituted or substituted with one or more nonionic and/or anionic substituents. Such substituents may include, for example, halogens, nitro, carboxy, carbonyl, sulfate, sulfonate, hydroxy, and alkoxy, and mixtures thereof.

Preferred laundry and cleaning compositions comprise the esters of geraniol and/or nerol. Geraniol and nerol are trans/cis structural isomers (at the 2,3 position double bond) of the molecules having the formula $HO—CH_2—CH=C(CH_3)—CH_2—CH_2—CH=C(CH_3)_2$.

Preferred esters for use herein are:

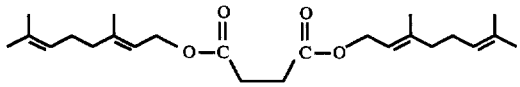

referred to herein as "digeranyl succinate" and

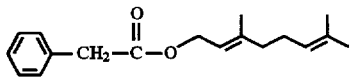

referred to herein as "geranyl phenylacetate" and

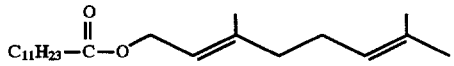

referred to herein as "geranyl laurate", as well as the neryl esters corresponding to these geranyl esters, including the mixed geranyl neryl succinate ester, and especially mixtures of the corresponding geranyl and neryl esters.

The present invention also relates to novel esters having the formula:

$$R—[C(=O)—O—CH_2—CH=C(CH_3)—CH_2CH_2CH=C(CH_3)_2]_n$$

wherein n is an integer of 2 or greater, and R is a substituted or unsubstituted, branched, straight, or cyclic $C_3$–$C_{20}$ alkylene, $C_2$–$C_{20}$ alkyl, $C_2$–$C_{20}$ alkynyl, aryl, or alkylaryl moeity, said substitutents being selected from one or more nonionic and/or anionic substituents. Such substituents may include, for example, halogens, nitro, carboxy, carbonyl, sulfate, sulfonate, hydroxy, and alkoxy, and mixtures thereof.

The present invention also encompasses a method for contacting an ester of an allylic alcohol perfume as described hereinbefore with a fabric. Preferred is a method for laundering soiled fabrics, comprising contacting said fabrics with an aqueous medium containing at least about 50 ppm, preferably from about 100 ppm to about 10,000 ppm of a laundry composition according to the above, preferably with agitation.

All percentages, ratios and proportions herein are by weight, unless otherwise specified. All documents cited are, in relevant part, incorporated herein by reference.

DETAILED DESCRIPTION OF THE INVENTION

The present invention compositions comprise a nonionic or anionic ester of an allylic alcohol perfume having the formula:

$$R—[C(=O)—O—CR_2'—CR''=CR_2'']_n$$

wherein R, R', $R''_2$, and R'" are as described hereinbefore. Again, these esters are formulated such that at least one of the possible alcohol materials obtained upon hydrolysis of the ester is a perfume material.

The geranyl and neryl esters are preferred in light of the fact that, depending on the acid moiety present in the ester compound and the use conditions, this ester can provide either a geraniol, nerol or linalool alcohol perfume, or mixtures thereof, upon hydrolysis.

Preferred compounds useful herein therefore have the formula:

$$R—[C(=O)—O—CH_2—CH=C(CH_3)—CH_2CH_2CH=C(CH_3)_2]_n$$

wherein R is as described hereinbefore and n is 1 or greater. Preferred R is selected from the group consisting of nonionic or anionic substituted or unsubstituted, branched, straight, or cyclic $C_{2-C20}$ alkylene, $C_1$–$C_{20}$ alkyl, $C_2$–$C_{20}$ alkynyl, aryl, or alkylaryl group.

Novel compounds according to the present invention have the formula:

$$R—[C(=O)—O—CH_2—CH=C(CH_3)—CH_2CH_2CH=C(CH_3)_2]_n$$

wherein n is an integer of 2 or greater, and R is a substituted or unsubstituted, branched, straight, or cyclic $C_3$–$C_{20}$ alkylene, $C_2$–$C_{20}$ alkyl, $C_2$–$C_{20}$ alkynyl, aryl, or alkylaryl moeity, said substitutents being selected from one or more nonionic and/or anionic substituents. Such substituents may include, for example, halogens, nitro, carboxy, carbonyl, sulfate, sulfonate, hydroxy, and alkoxy, and mixtures thereof.

Methods for manufacturing certain of these esters are known, and methods are also exemplified hereinafter.

The present invention compositions include both laundry and cleaning products, which are typically used for laundering fabrics and cleaning hard surfaces such as dishware and other surfaces in need of cleaning and/or disinfecting.

Preferred are those laundry compositions which result in contacting the ester of an allylic alcohol perfume as described herinbefore with fabric. These are to be understood to include not only detergent compositions which provide fabric cleaning benefits but also laundry compositions such as rinse added fabric softener compositions and dryer added compositions (e.g., sheets) which provide softening and/or antistatic benefits. The allylic perfume ester(s) typically comprise from about 0.01% to about 10%, preferrably from about 0.05% to about 5%, and more preferrably from about 0.1% to about 2%, by weight of the composition.

Optional ingredients useful for formulating such laundry and cleaning compositions according to the present invention include one or more of the following.

Cationic or Nonionic Fabric Softening Agents:

The preferred fabric softening agents to be used in the present invention compositions are quaternary ammonium compounds or amine precursors herein having the formula (I) or (II), below:

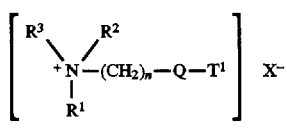

(I)

or

-continued

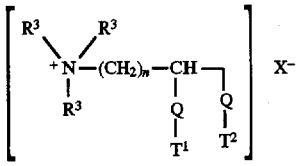

(II)

Q is —O—C(O)— or —C(O)—O— or —O—C(O)—O— or —$NR^4$—C(O)— or —C)O)—$NR^4$—;

$R^1$ is $(CH_2)_n$-Q-$T^2$ or $T^3$;

$R^2$ is $(CH_2)_m$-Q-$T^4$ or $T^5$ or $R^3$;

$R^3$ is $C_{1-C4}$ alkyl or $C_1$–$C_4$ hydroxyalkyl or H;

$R^4$ is H or $C_1$–$C_4$ alkyl or $C_1$–$C_4$ hydroxyalkyl;

$T^1, T^2, T^3, T^4, T^5$ are (the same or different) $C_{11}$–$C_{22}$ alkyl or alkenyl;

n and m are integers from 1 to 4; and $X^-$ is a softener-compatible anion, such as chloride, methyl sulfate, etc.

The alkyl, or alkenyl, chain $T^1, T^2, T^3, T^4, T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred. Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium chloride;
3) N,N-di(2-tallowyloxy-2-oxo-ethyl)-N,N-dimethyl ammonium chloride;
4) N,N-di(2-tallowyloxyethylcarbonyloxyethyl)-N,N-dimethyl ammonium chloride;
5)N-(2-tallowoyloxy-2-ethyl)-N-(2-tallowyloxy-2-oxo-ethyl) -N,N-dimethyl ammonium chloride;
6) N,N,N-tri(tallowyl-oxy-ethyl)-N-methyl ammonium chloride;
7) N-(2-tallowyloxy-2-oxoethyl)-N-(tallowyl)-N,N-dimethyl ammonium chloride; and
8) 1 ,2-ditallowyloxy-3-trimethylammoniopropane chloride;

and mixtures of any of the above materials.

Of these, compounds 1–7 are examples of compounds of Formula (I); compound 8 is a compound of Formula (II).

Particularly preferred is N,N-di(tallowoyl-oxy-ethyl)-N, N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g., replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, fornate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

For the preceeding fabric softening agents, the pH of the compositions herein is an essential parameter of the present invention. Indeed, it influences the stability of the quaternary ammonium or amine precursors compounds, especially in prolonged storage conditions.

The pH, as defined in the present context, is measured in the neat compositions at 20° C. For optimum hydrolytic stability of these compositions, the neat pH, measured in the above-mentioned conditions, must be in the range of from about 2.0 to about 4.5, preferably about 2.0 to about 3.5. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Softening agents also useful in the present invention compositions are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid, oleic and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono-and/or diesters of the polyglycerol polyols are preferred, the fatty acyl groups typically being those described hereinbefore for the sorbitan and glycerol esters.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. Nos.: 3,861,870, Edwards and Diehl; 4,308,151, Cambre; 3,886,075, Bernardino; 4,233,164, Davis; 4,401,578, Verbruggen; 3,974,076, Wiersema and Rieke; 4,237,016, Rudkin, Clint, and Young; and European Patent Application publication No. 472,178, by Yamamura et al., all of said documents being incorporated herein by reference.

For example, suitable fabric softener agents useful herein may comprise one, two, or all three of the following fabric softening agents:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing only one long chain acyclic aliphatic $C_{15}$–$C_{22}$ hydrocarbon group (preferably from about 3% to about 40%); and/or (c) cationic nitrogenous salts having two or more long chain acyclic aliphatic C15–$C_{22}$ hydrocarbon groups or one said group and an arylalkyl group (preferably from about 10% to about 80%); with said (a), (b) and (c) preferred percentages being by weight of the fabric softening agent component of the present invention compositions.

Following are the general descriptions of the preceeding (a), (b), and (c) softener ingredients (including certain specific examples which illustrate, but do not limit the present invention).

Component (a): Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (a) is a nitrogenous compound selected from the group consisting of the reaction product mixtures or some selected components of the mixtures. More specifically, the preferred Component (a) is compounds selected from the group consisting of substituted imidazoline compounds having the formula:

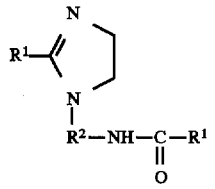

wherein $R^1$ is an acyclic aliphatic $C_{15-C21}$ hydrocarbon group and $R^2$ is a divalent $C_1$–$C_3$ alkylene group.

Component (a) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceeding structure $R^1$ is an aliphatic $C_{15}$–$C_{17}$ hydrocarbon group and $R^2$ is a divalent ethylene group).

Certain of the Components (a) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Component (b): The preferred Component (b) is a cationic nitrogenous salt containing one long chain acyclic aliphatic $C_{15}$–$C_{22}$ hydrocarbon group, preferrably selected from acyclic quaternary ammonium salts having the formula:

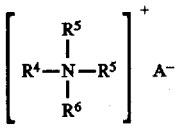

wherein $R^4$ is an acyclic aliphatic $C_{15}$–$C_{22}$ hydrocarbon group, $R^5$ and $R^6$ are $C_1$–$C_4$ saturated alkyl or hydroxy alkyl groups, and A- is an anion.

Examples of Component (b) are the monoalkyltrimethylammonium salts such as monotallowtrimethylammonium chloride, mono (hydrogenated tallow)trimethylammonium chloride, palmityltrimethyl ammonium chloride and soyatrimethylammonium chloride, sold by Sherex Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred.

Other examples of Component (b) are behenyltrimethylammonium chloride wherein $R^4$ is a $C_{22}$ hydrocarbon group and sold under the trade name Kemamine® Q2803-C by Humko Chemical Division of Witco Chemical Corporation; soyadimethylethylammonium ethylsulfate wherein $R^4$ is a $C_{16-C18}$ hydrocarbon group, $R^5$ is a methyl group, $R^6$ is an ethyl group, and A- is an ethylsulfate anion, sold under the trade name Jordaquat® 1033 by Jordan Chemical Company; and methyl-bis(2-hydroxyethyl)-octadecylammonium chloride wherein $R^4$ is a $C_{18}$ hydrocarbon group, $R^5$ is a 2-hydroxyethyl group and $R^6$ is a methyl group and available under the trade name Ethoquad® 18/12 from Armak Company.

Other examples of Component (b) are 1-ethyl-1-(2-hydroxy ethyl)-2-isoheptadecylimidazolinium ethylsulfate, available from Mona Industries, Inc. under the trade name Monaquat® ISIES; mono(tallowoyloxyethyl) hydroxyethyldimethylammonium chloride, i.e., monoester of tallow fatty acid with di(hydroxyethyl)dimethylammonium chloride, a by-product in the process of making diester of tallow fatty acid with di(hydroxyethyl)dimethylammonium chloride, i.e., di(tallowoyloxyethyl)dimethylammonium chloride.

Component (c): Preferred cationic nitrogenous salts having two or more long chain acyclic aliphatic $C_{15}$–$C_{22}$ hydrocarbon groups or one said group and an arylalkyl group which can be used either alone or as part of a mixture are selected from the group consisting of:

(i) acyclic quaternary ammonium salts having the formula:

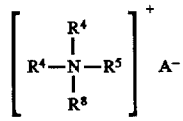

wherein $R^4$ is an acyclic aliphatic $C_{15}$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A- is an anion defined as above;

(ii) diamido quaternary ammonium salts having the formula:

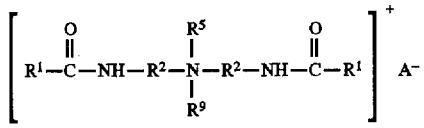

wherein $R^1$ is an acyclic aliphatic $C_{15}$–$C_{21}$ hydrocarbon group, each $R^2$ is the same or different divalent alkylene group having 1 to 3 carbon atoms, $R^5$ and $R^9$ are $C_1$–$C_4$ saturated alkyl or hydroxyalkyl groups, and A- is an anion;

(ii) diamino alkoxylated quaternary ammonium salts having the formula:

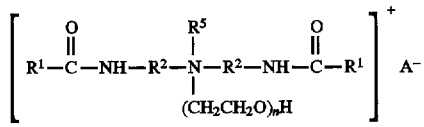

wherein n is equal to 1 to about 5, and $R^1$, $R^2$, $R^5$ and A- are as defined above;

(iv) diester quaternary ammonium (DEQA) compounds having the formula:

$$(R)_{4-m}-N^+-[(CH_2)_n-Y-R^2]_m\ A^-$$

wherein each Y=—O—(O)C—, or —C(O)—O—;

m=2 or 3;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof;

each $R^2$ is a long chain $C_{10}$–$C_{22}$ hydrocarbyl, or substituted hydrocarbyl substituent, preferably $C_{15}$–$C_{19}$ alkyl and/or alkenyl, most preferably $C_{15}$–$C_{18}$ straight chain alkyl and/or alkenyl; and the counterion, A-, can be any softener-compatible anion, for example, chloride, bromide, methylsulfate, formate, sulfate, nitrate and the like; and (v) mixtures thereof.

Examples of Component (c) are the well-known dialkyldi methylammonium salts such as ditallowdimethylammonium chloride, ditallowdimethylammonium methylsulfate, di(hydrogenatedtallow)dimethylammonium chloride, distearyldimethylammonium chloride, dibehenyldimethylammonium chloride. Di(hydrogenatedtallow)di methylammonium chloride and ditallowdimethylammonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation.

Other examples of Component (c) are methylbis (tallowamidoethyl)(2-hydroxyethyl)ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively: dimethylstearylbenzyl ammonium chloride sold under the trade names Varisoft® SDC by Witco Chemical Company and Ammonyx® 490 by Onyx Chemical Company; 1-methyl-1-tallowamidoethyl-2-tallowimidazolinium methylsulfate and 1-methyl-1-(hydrogenatedtallowamidoethyl)-2-(hydrogenatedallow) imidazolinium methylsulfate; they are sold under the trade names Varisoft® 475 and Varisoft® 445, respectively, by Witco Chemical Company.

The following are also non-limiting examples of Component (c) (wherein all long-chain alkyl substituents are straight-chain):

$[CH_3]_2\ ^+N[CH_2CH_2OC(O)R^2]\ Cl^-$ $[HOCH(CH_3)CH_2][CH_3]\ ^+N[CH_2CH_2OC(O)C_{15}H_{31}]_2\ Br^-$ $[C_2H_5]_2\ ^+N[CH_2CH_2OC(O)C_{17}H_{35}]_2\ Cl^-$ $[CH_3][C_2H_5]\ ^+N[CH_2CH_2OC(O)C_{13}H_{27}]_2 I^-$ $[C_3H_7][C_2H_5]\ ^+N[CH_2CH_2OC(O)C_{15}H_{31}]_2\ ^-SO_4CH_3$

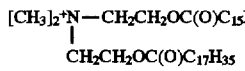

$[CH_2CH_2OH][CH_3]\ ^+N[CH_2CH_2OC(O)R^2]_2\ Cl^-$ where —$C(O)R^2$ is derived from soft tallow and/or hardened tallow fatty acids. Especially preferred is diester of soft and/or hardened tallow fatty acids with di(hydroxyethyl) dimethylammonium chloride, also called di(tallowoyloxyethyl)dimethylammonium chloride.

Since the foregoing compounds (diesters) are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. Ranges of pH for making stable softener compositions containing diester quaternary ammonium fabric softening compounds are disclosed in U.S. Pat. No. 4,767,547, Straathof and Konig, issued Aug. 30, 1988, and is incorporated herein by reference.

These types of compounds and general methods of making them are disclosed in U.S. Pat. No. 4,137,180, Naik et al., issued Jan. 30, 1979, which is incorporated herein by reference.

A preferred composition contains Component (a) at a level of from about 10% to about 80%, Component (b) at a level of from about 3% to about 40%, and Component (c) at a level of from about 10% to about 80%, by weight of the fabric softening component of the present invention compositions.

An even more preferred composition contains Component (a): the reaction product of about 2 moles of hydrogenated tallow fatty acids with about 1 mole of N-2-hydroxyethylethylenediamine and is present at a level of from about 20% to about 70% by weight of the fabric softening component of the present invention compositions; Component (b): mono(hydrogenated tallow)trimethyl ammonium chloride present at a level of from about 3% to about 30% by weight of the fabric softening component of the present invention compositions; Component (c): selected from the group consisting of di(hydrogenatedtallow) dimethylammonium chloride, ditallowdimethylammonium chloride, methyl-1-tallowamidoethyl-2-tallowimidazolinium methylsulfate, diethanol ester dimethylammonium chloride, and mixtures thereof; wherein Component (c) is present at a level of from about 20% to about 60% by weight of the fabric softening component of the present invention compositions; and wherein the weight ratio of said di(hydrogenated tallow)dimethylammonium chloride to said methyl-1-tallowamidoethyl-2-tallowimidazolinium methylsulfate is from about 2:1 to about 6:1.

In the cationic nitrogenous salts described hereinbefore, the anion A- provides charge neutrality. Most often, the anion used to provide charge neutrality in these salts is a halide, such as chloride or bromide. However, other anions can be used, such as methylsulfate, ethylsulfate, hydroxide, acetate, fornate, citrate, sulfate, carbonate, and the like. Chloride and methylsulfate are preferred herein as anion A-.

The amount of fabric softening agent (fabric softener) in liquid compositions of this invention is typically from about 2% to about 50%, preferably from about 4% to about 30%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

Fully formulated fabric softening compositions preferably contain, in addition to the hereinbefore described components, one or more of the following ingredients.

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Still other optional ingredients are Soil Release Polymers, bacteriocides, colorants, perfumes, preservatives, optical brighteners, anti ionisation agents, antifoam agents, and the like.

Enzymes—Enzymes are included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.001 mg to about 3 mg, of active enzyme per gram of the composition. Stated otherwise, the compositions herein will typically comprise from about 0.001% to about 5%, preferably 0.01%–2% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of B. subtilis and B. licheniforms. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985). Other proteases include Protease A (see European Patent Application 130,756, published Jan. 9, 1985) and Protease B (see European Patent Application Ser. No. 87303761.8, filed Apr. 28, 1987, and European Patent Application 130,756, Bott et al, published Jan. 9, 1985). Other proteases include Protease A (see European Patent Application 130,756, published Jan. 9, 1985) and Protease B (see European Patent application Ser. No. 87303761.8, filed Apr. 28, 1987, and European Patent Application 130,756, Bott et al, published Jan. 9, 1985). Most preferred is what is called herein "Protease C", which is a variant of an alkaline serine protease from *Bacillus*, particularly *Bacillus lentus*, in which arginine replaced lysine at position 27, tyrosine replaced valine at position 104, serine replaced asparagine at position 123, and alanine replaced threonine at position 274. Protease C is described in EP 90915958:4; U.S. Pat. No. 5,185,250; and U.S. Pat. No. 5,204,015. Also especially preferred are protease which are described in copending application U.S. Ser. No. 08/136,797, entitled Protease-containing Cleaning Compositions and copending application U.S. Ser. No. 08/136,626, entitled Bleaching Compositions Comprising Protease Enzymes, which are incorporated herein by reference. Genetically modified variants, particularly of Protease C, are also included herein.

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued March 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. Cellulases such as CAREZYME (Novo) are especially useful, since they provide additional softening and appearance benefits to fabrics laundered in the present compositions.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. It may be desired to use, in combination with these peroxidases, materials viewed as being peroxidase accelerators such as phenolsulfonate and/or phenothiazine.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat.

No. 4,101,457, Place et al, issued Jul. 18, 1978, and in U.S. Pat. No. 4,507,219, Hughes, issued March 26, 1985, both. Enzyme materials useful for liquid detergent formulations, and their incorporation into such formulations, are disclosed in U.S. Pat. No. 4,261,868, Hora et al, issued Apr. 14, 1981.

Enzyme Stabilizers—A preferred optional ingredient for use in the present compositions is enzyme stabilizers. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570. The enzymes employed herein can be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.)

Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid. It is to be recognized that such materials may also be used in formulations as the sole stabilizer as well as being used in combination with added calcium and/or magnesium ions.

Finally, it may be desired to add chlorine scavengers, especially to protease-containing compositions, to protect the enzymes from chlorine typically present in municipal water supplies. Such materials are described, for example, in U.S. Pat. No. 4,810,413 to Pancheri et al.

Various other optional adjunct ingredients may also be used to provide fully-formulated detergent compositions. The following ingredients are described for the convenience of the formulator, but are not intended to be limiting thereof.

Detersive Surfactants—Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ allyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ allyl alkoxy sulfates ("$AE_xS$"; especially x up to about 7 EO ethoxy sulfates), $C_{18}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12-C18}$ alpha-sulfonated fatty acid esters. If desired, the conventional nonionic and amphoteric surfactants such as the $C_{12-C18}$ alkyl ethoxylates ("AE") including the so-called narrow peaked alkyl ethoxylates and $C_{6-C12}$ alkyl phenol alkoxylates (especially ethoxylates and rnixed ethoxy/propoxy), $C_{12}$–CI18 betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10-C20}$ conventional soaps may also be used. If high sudsing is desired, the branched-chain $C_{10}$–$C_{16}$ soaps may be used. Mixtures of anionic and nonionic surfactants are especially useflil. Other conventional useful surfactants are listed in standard texts.

Builders—Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder, preferably from about 1% to about 80%. Liquid formulations typically comprise from about 5% to about 50%, more typically about 5% to about 30%, by weight, of detergent builder. Granular formulations typically comprise from about 1% to about 80%, more typically from about 5% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.0:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_{z/n}[AlO_2)_z(SiO_2)_y]xH_2O$$

wherein z and y are integers usually of at least 6, the molar ratio of z to y is in the range from 1.0 to 0, and x is an integer from 0 to about 264, and M is a Group IA or IIA element, e.g., Na, K, Mg, Ca with valence n.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued October 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, pyromellitic, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids such as oleic acid and/or its salts, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning or other cleaning purposes that are now known or become known. These include oxygen bleaches as well as other bleaching agents. Perborate bleaches, e.g., sodium perborate (e.g., mono- or tetra-hydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

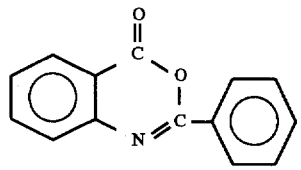

Still another class of preferred bleach activators includes the acyl lactam activators, especially acyl caprolactams and acyl valerolactams of the formulae:

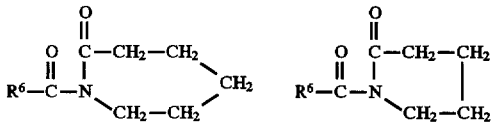

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3(1,4,7\text{-trimethyl-}1,4,7\text{-triazacyclononane})_2(PF_6)_2$, $Mn^{III}_2(u\text{-}O)_1(u\text{-}OAc)_2(1,4,7\text{-trimethyl-}1,4,7\text{-triazacyclononane})_2(ClO_4)_2$, $Mn^{IV}_4(u\text{-}O)_6(1,4,7\text{-triazacyclononane})_4(ClO_4)_4$, $Mn^{III}Mn^{IV}_4(u\text{-}O)_1(u\text{-}OAc)_2(1,4,7\text{-trimethyl- }1,4,7\text{-triazacyclononane})_2(ClO_4)_3$, $Mn^{IV}(1,4,7\text{-trimethyl- }1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Other preferred optional ingredients include polymeric soil release agents, materials effective for inhibiting the transfer of dyes from one fabric to another during the cleaning process (i.e., dye transfer inhibiting agents), polymeric dispersing agents, suds suppressors, optical brighteners or other brightening or whitening agents, chelating agents, fabric softening clay, anti-static agents, other active ingredients, carriers, hydrotropes, processing aids, dyes or pigments, solvents for liquid formulations, solid fillers for bar compositions, etc.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

Granular detergents can be prepared, for example, by spray-drying (final product density about 520 g/l) or agglomerating (final product density above about 600 g/l) the Base Granule. The remaining dry ingredients can then be admixed in granular or powder form with the Base Granule, for example in a rotary mixing drum, and the liquid ingredients (e.g., nonionic surfactant and perfume) can be sprayed on.

The detergent compositions herein will preferably be formulated such that, during use in aqueous cleaning operations, the wash water will have a pH of between about 6.5 and about 11, preferably between about 7.5 and 10.5. Laundry products are typically at pH 9–11. Techniques for controlling pH at recommended usage levels include the use of buffers, alkalis, acids, etc., and are well known to those skilled in the art.

The following examples illustrate the esters and compositions of this invention, but are not intended to be limiting thereof.

EXAMPLE I: Digeranyl Succinate

Synthesis (a): A mixture of geraniol and nerol (approximately 70:30 by weight) in the amount of 50.00 g (0.324 mol) and succinic anhydride in the amount of 16.22 g (0.162 mol) are combined with 100 mL of toluene. The mixture is heated to reflux for 18 h at which time the theoretical amount of water is collected. The product mixture is concentrated first by rotary evaporation, and then by Kugelrohr distillation, to give a light yellow oil. Purification of the product by column chromatography provides a colorless oil. Purity of the product is determined by thin layer chromatography and the structure confirmed by $^{13}C$ and $^{1}H$ NMR.

Synthesis (b): A mixture of geraniol and nerol (approximately 70:30 by weight) in the amount of 23.70 g (0.154 mol) and triethylamine in the amount of 15.70 g (0.154 mol) are added to 100 mL of dichloromethane. The mixture is treated with a solution of succinyl chloride in the amount of 12.53 g (0.077 mol) dissolved in 10 mL of dichloromethane over 30 min. The mixture is allowed to reflux for 1 h and then cooled to room temperature. After filtering the mixture, the fitrate is concentrated by rotary evaporation. The resulting oil is taken up in 200 mL of dichloromethane and the mixture washed with two 50 mL portions of brine and 50 mL of 10% $NaHCO_3$ solution. The organic layer is dried over $MgSO_4$, filtered, and concentrated by rotary evaporation to leave a dark brown oil. Purification of the product by column chromatography provides a near colorless oil. Purity of the product is determined by thin layer chromatography and the structure confirmed by $^{13}C$ and $^{1}H$ NMR.

Synthesis (c): A mixture of geraniol and nerol (approximately 70:30 by weight) in the amount of 94.86 g (0.615 mol) and succinic anhydride in the amount of 20.51 g (0.205 mol) are combined at room temperature. The mixture is heated to 140° C. for 6 h while water is removed using an argon sparge. After cooling to room temperature, the mixture is placed in a Kugelrohr oven and concentrated at 80°–85 ° C. for 5.5 h. Purity of the product is determined by thin layer chromatography and the structure confirmed by $^{13}C$ and $^{1}H$ NMR.

EXAMPLE II: Geranyl laurate

A mixture of geraniol and nerol (approximately 70:30 by weight) in the amount of 50.00 g (0.324 mol) and triethylamine in the amount of 36.08 g (0.357 mol) are combined with 300 mL of toluene. The reaction mixture is heated to reflux and lauroyl chloride in the amount 70.92 g (0.324 mol) is added dropwise over 15 min. After heating for an additional 30 min, the product mixture is cooled to room temperature and filtered. The filtrate is washed three times with 100 niL of saturated $NaHCO_3$, 100 mL of water, and dried over $MgSO_4$. After filtration, the filtrate is concentrated by rotary evaporation followed by Kugelrohr distillation. Purity of the product is determined by thin layer chromatography and the structure confirmed by $^{13}C$ and $^{1}H$ NMR.

EXAMPLE III: Geraniyl Phenylacetate

A mixture of geraniol and nerol (approximately 70:30 by weight) in the amount of 51.02 g (0.324 mol) and triethylamine in the amount of 33.13 g (0.324 mol) are combined with 275 mL of dichloromethane. The reaction mixture is treated with a solution of phenylacetyl chloride in the amount 51.14 g (0.324 mol) dissolved in 100 ml of dichloromethane over 1 h. After heating to reflux for 1 h, the product mixture is cooled to room temperature, washed with 100 mL of brine twice, 100 mL of saturated $NaHCO_3$ solution twice, 100 mL of water, and dried over $MgSO_4$. The filtrate is concentrated by rotary evaporation followed by Kugelrohr distallation. Purification of the product by column chromatography provides a colorless oil. Purity of the product is determined by thin layer chromatography and the structure confirmed by $^{13}C$ and $^{1}H$ NMR.

EXAMPLE IV

Liquid fabric softener compositions according to the present invention are formulated as follows:

| Ingredient | A Wt. % | B Wt. % | C Wt. % | D Wt. % | E Wt. % |
|---|---|---|---|---|---|
| DEQA (1) | 26.0 | 26.0 | 26.0 | 26.0 | 26.0 |
| Ethanol | 4.2 | 4.2 | 4.2 | 4.2 | 4.2 |
| HCl | 0.01 | 0.01 | 0.01 | 0.01 | 0.01 |
| $CaCl_2$ | 0.46 | 0.46 | 0.46 | 0.46 | 0.46 |
| Silicone Antifoam (2) | 0.15 | 0.15 | 0.15 | 0.15 | 0.15 |
| Preservative (3) | 0.0003 | 0.0003 | 0.0003 | 0.0003 | 0.0003 |
| Perfume | 1.20 | 1.35 | — | 1.35 | 1.20 |
| Digeranyl Succinate (4) | 0.76 | 0.76 | — | — | — |
| Geranyl laurate (5) | — | — | 1.30 | 1.30 | — |
| Geranyl Phenylacetate (6) | — | — | — | — | 1.05 |
| Water | 67.22 | 67.07 | 68.08 | 66.73 | 66.78 |

(1) Di-(soft-tallowyloxyethyl) dimethyl ammonium chloride
(2) DC-2310, sold by Dow-Coring
(3) Kathon CG, sold by Rohm & Haas
(4) 1,4-Butandioic acid, 3,7-dimethyl-2,6-octadienyl ester
(5) Dodecanoic acid, 3,7-dimethyl-2,6-octadienyl ester
(6) Phenylacetic acid, 3,7-dimethyl-2,6-octadienyl ester

EXAMPLE V

Additional liquid fabric conditioner formulas include the following.

| Ingredient | F Wt. % | G Wt. % | H Wt. % | I Wt. % | J Wt. % |
|---|---|---|---|---|---|
| DEQA (7) | 5.40 | 18.16 | 18.16 | 22.7 | 22.7 |
| Poly(glycerol monostearate) | 0.83 | 2.40 | 2.40 | 3.00 | 3.00 |
| Tallow Alcohol Ethoxylate - 25 | 0.36 | 1.20 | 1.20 | 1.50 | 1.50 |
| HCl | 0.02 | 0.02 | 0.02 | 0.02 | 0.02 |
| $CaCl_2$ | — | 0.20 | 0.20 | 0.30 | 0.30 |
| Silicon Anti-foam | — | 0.019 | 0.019 | 0.019 | 0.019 |
| Soil Release Polymer | — | 0.19 | 0.19 | 0.19 | 0.19 |
| Perfume | 0.187 | 0.70 | 0.70 | 0.90 | 0.90 |
| Blue Dye | 0.002 | 0.005 | 0.005 | 0.006 | 0.006 |
| Digeranyl Succinate (4) | 0.095 | 0.35 | — | 0.45 | — |
| Geranyl Phenylacetate (6) | — | — | 0.35 | — | 0.45 |
| Water | 93.11 | 74.34 | 74.34 | 70.92 | 70.92 |

(4) 1,4-Butandioic acid, 3,7-dimethyl-2,6-octadienyl ester
(6) Phenylacetic acid, 3,7-dimethy-2,6-octadienyl ester
(7) Di-(tallowyloxyethyl) dimethyl ammonium chloride

EXAMPLE VI

Additional dryer added fabric conditioner formulas include the following.

| Component | K Wt. % | L Wt. % | M Wt. % | N Wt. % | O Wt. % |
|---|---|---|---|---|---|
| DEQA (13) | 39.16 | 34.79 | — | — | — |
| DEQA (14) | — | — | 51.81 | — | — |
| DTDMAMS (15) | — | — | — | 20.64 | 25.94 |

-continued

| Component | K Wt. % | L Wt. % | M Wt. % | N Wt. % | O Wt. % |
|---|---|---|---|---|---|
| Co-Softener (16) | 54.41 | 40.16 | 27.33 | 33.04 | 41.52 |
| Glycosperse S-20 (17) | — | — | 15.38 | — | — |
| Glycerol Monostearate | — | — | | 20.87 | 26.23 |
| Perfume | 1.61 | 1.65 | 1.52 | 1.61 | 1.21 |
| Perfume/Cyclodextrin Complex | — | 18.88 | — | 19.13 | — |
| Degeranyl Succinate (4) | 0.80 | 0.50 | 0.80 | 0.80 | 1.20 |
| Clay (18) | 4.02 | 4.02 | 3.16 | 3.91 | 3.90 |

(4) 1,4-Butandioic acid, 3,7-dimethyl-2,6-octadienyl ester
(13) Di-(oleyloxyethyl) dimethyl ammonium methylsulfate
(14) Di-(soft-tallowyloxyethyl) hydroxyethyl methyl ammonium methylsulfate
(15) Ditallow dimethyl ammonium methylsulfate
(16) 1:2 Ratio of stearyldimethyl amine triple-pressed stearic acid
(17) Polyethoxylated sorbitan monostearate, available from Lonza
(18) Calcium Bentonite Clay, Bentonite L, sold by Southern Clay Products

EXAMPLE VII

A fabric conditioner bar is prepared having the following components.

| Component | Wt. % |
|---|---|
| Co-Softener (16) | 70.00 |
| Neodol 45-13 (19) | 13.00 |
| Ethanol | 1.00 |
| Dye | 0.01 |
| Perfume | 0.75 |
| Digeranyl Succiante (4) | 0.38 |
| Water | 14.86 |

What is claimed is:

1. Laundry and cleaning compositions comprising:

(a) from about 0.01% to about 10%, by weight of the composition, of a nonionic or anionic ester of an allylic alcohol perfume having the formula:

$$R-[\overset{\overset{\displaystyle O}{\|}}{C}-O-CR_2'-CR''=CR_2''']_n$$

wherein R is selected from the group consisting of nonionic or anionic substituted or unsubstituted $C_1$–$C_{30}$ straight, branched or cyclic alkyl, alkenyl, alkynyl, alkylaryl, or aryl group; each of R', R", and R'" is independently selected from the group consisting of hydrogen, or a nonionic or anionic substituted or unsubstituted $C_1$–$C_{25}$ straight, branched or cyclic alkyl, alkenyl, alkynyl, alkylaryl, or aryl group; and n is an integer of 1 or greater; and (b) from about 90% to about 99.99%, by weight of the composition, of ingredients useful for formulating laundry and cleaning compositions.

2. Laundry and cleaning compositions according to claim 1 wherein R is selected from the group consisting of nonionic or anionic substituted or unsubstituted $C_1$–$C_{20}$ straight, branched or cyclic alkyl, alkenyl, alkynyl, alkylaryl, or aryl group; at least one R' is hydrogen; R" is hydrogen; one R'" is hydrogen, methyl, or ethyl and the other R'" is a straight, branched, or cyclic, nonionic or anionic substituted or unsubstituted, $C_1$–$C_{20}$ alkyl, alkenyl or alkylaryl group; and substituents are selected from the group consisting of halogens, nitro, carboxy, carbonyl, sulfate, sulfonate, hydroxy, and alkoxy, and mixtures thereof.

3. Laundry and cleaning compositions according to claim 1 wherein R' and R" are hydrogen; and one R'" is selected from the group consisting of hydrogen, methyl, or ethyl, and the other R'" is a straight, branched, or cyclic, nonionic or anionic substituted or unsubstituted, $C_1$–$C_{10}$ alkyl or alkenyl group.

4. Laundry and cleaning compositions according to claim 1 comprising ingredients useful for formulating laundry and cleaning compositions selected from the group consisting of cationic or nonionic fabric softening agents, enzymes, enzyme stabilizers, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof.

5. Laundry and cleaning compositions comprising:

(a) from about 0.01% to about 10%, by weight of the composition, of a nonionic or anionic ester of an allylic alcohol perfume having the formula:

$$R-[\overset{\overset{\displaystyle O}{\|}}{C}-O-CH_2-CH=C(CH_3)-CH_2CH_2CH=C(CH_3)_2]_n$$

wherein R is selected from the group consisting of nonionic or anionic substituted or unsubstituted $C_1$–$C_{30}$ straight, branched or cyclic alkyl, alkenyl, alkynyl, alkylaryl, or aryl group; and n is an integer of 1 or greater; and (b) from about 90% to about 99.99%, by weight of the composition, of ingredients useful for formulating laundry and cleaning compositions.

6. Laundry and cleaning compositions according to claim 5 wherein R is selected from the group consisting of nonionic or anionic substituted or unsubstituted, branched, straight, or cyclic $C_2$–$C_{20}$ alkylene, $C_1$–$C_{20}$ alkyl, $C_2$–$C_{20}$ alkynyl, aryl, or alkylaryl group.

7. Laundry and cleaning compositions according to claim 6 wherein the ester of an allylic alcohol perfume is selected from the group consisting of digeranyl succinate, dineryl succinate, geranyl neryl succinate, geranyl phenylacetate, neryl phenylacetate, geranyl laurate, neryl laurate, and mixtures thereof.

8. Laundry and cleaning compositions according to claim 7 comprising from about 0.05% to about 5% of ester by weight of the composition.

9. Laundry and cleaning compositions according to claim 5 which are fabric softening compositions comprising cationic or nonionic fabric softening agents.

10. Laundry and cleaning compositions according to claim 9 in the form of a bar.

11. Laundry and cleaning compositions according to claim 8 which are fabric softening compositions comprising cationic or nonionic fabric softening agents.

12. Laundry and cleaning compositions according to claim 11 in the form of a bar.

13. A method for laundering soiled fabrics, said method comprising contacting said fabrics with an aqueous medium containing at least about 50 ppm of a laundry composition according to claim 1.

14. A method for laundering soiled fabrics, said method comprising contacting said fabrics with an aqueous medium containing at least about 50 ppm of a laundry composition according to claim 5.

15. A method for laundering soiled fabrics, said method comprising contacting said fabrics with an aqueous medium containing at least about 50 ppm of a fabric softening composition according to claim 9.

16. A method for laundering soiled fabrics, said method comprising contacting said fabrics with an aqueous medium containing at least about 50 ppm of a fabric softening composition according to claim 11.

* * * * *